137-13 SR
9/23/80 OR 4,223,691

United States Patent [19]
Titus
[11] 4,223,691
[45] Sep. 23, 1980

[54] ADDITIVES TO IMPROVE THE PIPELINE TRANSPORTATION OF COLD WATER SLURRIES

[75] Inventor: Paul E. Titus, Houston, Tex.

[73] Assignee: Shell Oil Company, Houston, Tex.

[21] Appl. No.: 972,841

[22] Filed: Dec. 26, 1978

[51] Int. Cl.³ ..... F17D 1/16
[52] U.S. Cl. ..... 137/13; 403/49; 403/48

[58] Field of Search ..... 137/13; 406/49, 47, 406/48

[56] References Cited

U.S. PATENT DOCUMENTS 3,865,547 2/1975 Titus ..... 406/49

*Primary Examiner*—Alan Cohan

[57] ABSTRACT

The present invention relates to a method of increasing the density of an aqueous liquid in a slurry by forming a solution of the aqueous liquid and saccharide.

7 Claims, No Drawings

ADDITIVES TO IMPROVE THE PIPELINE TRANSPORTATION OF COLD WATER SLURRIES

BACKGROUND OF THE INVENTION

The pipeline transportation of coal in water slurries has many advantages but also includes a major disadvantage; its requirement for huge quantities of water. In the western United States, which contains much of the country's coal, the scarcity of water is severe. What water is available in these regions is barely sufficient for domestic use, and shipping the water out in coal slurries may not be attractive. While recycling of the water to the origin of the slurry pipelines would overcome much of the water supply problem, the water requirements would still remain substantial, and the cost of recycling might very well be prohibitive.

SUMMARY OF THE INVENTION

The present invention provides a method for increasing the density of an aqueous liquid in a slurry with solid particles comprising forming a solution of the aqueous liquid and a saccharide. Preferably, the saccharide is sucrose, and the solid particles are coal. More preferably, the slurry is in a pipeline and the aqueous solution is recycled from the terminus of the pipeline to the origin.

The present invention also pertains to a slurry comprising solid particles in a water/saccharide solution. Preferably, the saccharide is sucrose, and the solid particles are coal in a slurry pipeline. More preferably, the aqueous solution of sucrose is recycled from the terminus to the origin of the pipeline.

DESCRIPTION OF PREFERRED EMBODIMENTS

In accordance with the present invention, the above-noted problems of the art are solved by increasing the density of the water of the slurry by the addition of a saccharide such as sugar thereto. Accordingly, less water is then required to form a slurry with the same quantity of solid particles. Sugar is not only readily available and non-toxic, but it also has the advantage of reducing the corrosion of steel in the presence of water. The cost of the addition of sugar is reduced by continuously recycling the slurry water to the origin of the pipeline. Thus, not only is less water initially required, due to the increased density of the solution, but less water is also required due to recycling.

The present invention is useful not only with coal but also with other slurries wherein the solid particles are iron ore, sulfur, limestone, and fertilizer components such as phosphates.

The preferred saccharide is sucrose but other saccharides are also useful. A concentration of 20% to 60% w saccharide is preferred, and a concentration of 35 to 45% w is more preferred. Any concentration, of course, achieves some of the benefits of the invention.

Because of the increased density of the water/saccharide solution, a larger particle size range of particles is suitable for use in the invention. Thus, the range may vary from 0.1 mm to 5 mm, or more preferably from 1 mm to 3 mm. Since larger particle sizes are suitable for use with the invention, this feature reduces grinding costs which further offset the cost of the saccharide. In addition, the cost of coal drying and reconstitution at the terminal end of the pipeline are also substantially reduced.

Make-up water and make-up saccharide are necessary since some solution is lost with separation of the solid particles. This amounts to about 5% w of water and about 5% w of saccharide, based on the total amount of water and saccharide initially in the pipeline.

I claim as my invention:

1. A method for substantially increasing the density of an aqueous liquid in a slurry with coal particles predominantly varying in particle size from 0.1 mm to 5 mm comprising forming a solution of the aqueous liquid and 20% to 60% w of a saccharide.

2. The method of claim 1, wherein the slurry is in a pipeline.

3. The method of claim 2, wherein the solid particles and solution are separated and the solution is recycled to the origin of the pipeline.

4. The method of claim 1, wherein the saccharide is sucrose.

5. A pipeline transportable slurry comprising coal particles predominately varying in particle size from 0.01 mm to 5 mm in a solution with water and 20% to 60% w of a saccharide.

6. The slurry of claim 5, wherein the saccharide is sucrose.

7. The slurry of claim 6, wherein the particle size range of the coal varies from about 1 mm to 3 mm.

* * * * *